US012465137B2

(12) United States Patent
Zhu et al.

(10) Patent No.: US 12,465,137 B2
(45) Date of Patent: Nov. 11, 2025

(54) HANDLE FOR BRUSH HEAD

(71) Applicant: Kao USA Inc., Cincinnati, OH (US)

(72) Inventors: Yanbo Zhu, Sharonville, OH (US); Monica L. Oltmanns, Milford, OH (US)

(73) Assignee: Kao USA Inc., Cincinnati, OH (US)

( * ) Notice: Subject to any disclaimer, the term of this patent is extended or adjusted under 35 U.S.C. 154(b) by 305 days.

(21) Appl. No.: 17/992,267

(22) Filed: Nov. 22, 2022

(65) Prior Publication Data

US 2024/0164513 A1 May 23, 2024

(51) Int. Cl.

| | |
|---|---|
| ***A46B 5/02*** | (2006.01) |
| ***A46B 5/00*** | (2006.01) |
| ***A47K 7/02*** | (2006.01) |

(52) U.S. Cl.

CPC ..... *A46B 5/02* (2013.01); *A46B 5/0095* (2013.01); *A47K 7/028* (2013.01); *A46B 2200/1006* (2013.01)

(58) Field of Classification Search

CPC ..... B25G 1/102

See application file for complete search history.

(56) References Cited

U.S. PATENT DOCUMENTS

| | | | | |
|---|---|---|---|---|
| 6,094,768 | A | 8/2000 | Hugon et al. | |
| 6,220,673 | B1 | 4/2001 | Russell et al. | |
| 7,934,320 | B2 * | 5/2011 | Gratsias | B26B 21/522 30/32 |
| 8,256,055 | B2 | 9/2012 | Kressner | |
| 2004/0231083 | A1 | 11/2004 | Zaksenberg | |
| 2006/0183076 | A1 | 8/2006 | Nikolov | |
| 2008/0201880 | A1 * | 8/2008 | Battaglia | A46B 13/02 15/88.4 |
| 2010/0132731 | A1 * | 6/2010 | Waitesmith | A46B 5/021 15/171 |
| 2012/0193251 | A1 | 8/2012 | Rittmann | |
| 2016/0152067 | A1 | 6/2016 | Rittmann | |
| 2019/0099249 | A1 * | 4/2019 | Lai | A46B 9/045 |

FOREIGN PATENT DOCUMENTS

| | | |
|---|---|---|
| CN | 2495186 Y | 6/2002 |
| CN | 2699727 Y | 5/2005 |
| CN | 2827102 Y | 10/2006 |

(Continued)

OTHER PUBLICATIONS

Bic® Soleil® Sensitive Advanced™M Women's Disposable 5-Blade Razor, <https://us.bic.com/en_us/bic-soleil-sensitive-advanced-women-s-disposable-razor-five-blade-count-of-5-for-a-flawlessly-smooth-shave.html> from the internet; Accessed on Dec. 20, 2022.

(Continued)

*Primary Examiner* — Shay Karls

(74) *Attorney, Agent, or Firm* — FROST BROWN TODD LLP

(57) ABSTRACT

A handle for attachment to a brush head includes a first section that has a frustoconical profile spanning from a proximal plane to a first distal plane, for allowing a finger of a hand of a person to rest. The frustoconical profile increases in width in a 360° direction along an oblique axis between the proximal plane and the first distal plane. A terminal point of the handle is aligned with a plate of the brush head when the handle is attached to the brush head.

4 Claims, 13 Drawing Sheets

(56) References Cited

FOREIGN PATENT DOCUMENTS

| | | | |
|---|---|---|---|
| CN | 201888423 | U | 7/2011 |
| CN | 102551319 | A | 7/2012 |
| CN | 203493044 | U | 3/2014 |
| CN | 205233805 | U | 5/2016 |
| CN | 206548091 | U | 10/2017 |
| CN | 207168129 | U | 4/2018 |
| CN | 207168132 | U | 4/2018 |
| CN | 208837199 | U | 5/2019 |
| CN | 208850772 | U | 5/2019 |
| CN | 208957099 | U | 6/2019 |
| CN | 209332347 | U | 9/2019 |
| CN | 209360960 | U | 9/2019 |
| CN | 210408650 | U | 4/2020 |
| CN | 210872156 | U | 6/2020 |
| CN | 211483356 | U | 9/2020 |
| CN | 212088576 | U | 12/2020 |
| CN | 212938588 | U | 4/2021 |
| CN | 212995157 | U | 4/2021 |
| CN | 213128485 | U | 5/2021 |
| CN | 213910647 | U | 8/2021 |
| DE | 1834537 | U | 7/1961 |
| KR | 20-0348352 | Y1 | 4/2004 |
| KR | 20-0444502 | Y1 | 5/2009 |
| WO | WO 2007/045821 | A2 | 4/2007 |
| WO | WO 2016/204224 | A1 | 12/2016 |
| WO | WO 2018/219085 | A1 | 12/2018 |
| WO | WO 2018/219086 | A1 | 12/2018 |

OTHER PUBLICATIONS

U.S. Appl. No. 29/860,762, entitled "Handle for Brush Head," filed Nov. 22, 2022.

Gillette® Mach3 Men's Disposable Razor, < https://www.amazon.com/Gillette-Disposable-Razor-Razors-Blades> from the internet; Accessed on Dec. 20, 2022.

Ikea® Antagen Dish Brush, <https://www.ikea.com/US/en/p/antagen-dish-brush-assorted-colors> from the internet; Accessed on Dec. 20, 2022.

Ikea® Plastic Dishwashing Brush, < https://www.amazon.com/05247000864-Plastic-dishwashing-Brush-Multicolored> from the internet; Accessed on Dec. 20, 2022.

Kao ClearClean® Toothbrush, <https://www.kao.com/jp/en/products/clearclean> from the internet; Accessed on Dec. 20, 2022.

Kao DeepClean® Toothbrush, <https://www.kao.com/jp/en/products/deepclean/> from the internet; Accessed on Feb. 13, 2023.

Klickpick® Home Dish Scrubber Brush, <https://www.amazon.com/Klickpick-Home-Scrubber-Dishwashing-Scrubbing> from the internet; Accessed on Dec. 20, 2022.

* cited by examiner

HANDLE FOR BRUSH HEAD

FIELD OF TECHNOLOGY

The present application relates to a handle, and in particular, a handle for use with a brush head.

BACKGROUND

Various brushes exist for various applications, including painting, cleaning, and personal care. Certain brushes, for instance toothbrushes or brushes for cleaning dishes, include handles that are designed to provide a more ergonomic experience to a user. Such designs may include angling of a handle with respect to a brush head and arching or curvature of the handle.

Handles with such designs may be limited in their application. For instance, a handle may work well as part of a toothbrush, but not as part of a face brush. That is, a user experience for a toothbrush (i.e., how a toothbrush is held and oriented) is different from that of a brush applied to a facial skin surface. A handle designed for a toothbrush may, for instance, be harder to hold and apply to one's face. This could result in pain to the user and difficulty maneuvering the handle and brush head during use. Such issues may also arise due to a handle being too long, as well as not properly designed, for such a use.

Thus, a need exists for a handle designed to be used with a brush head for application to a facial skin surface.

Commercial examples of handles for brushes include ClearClean or DeepClean (trademarked brands owned by Kao Corporation) Antagen dish brush from Ikea®, Ikea® 05247000864 plastic dishwashing brush, and Klickpick home dish scrubber brush.

Other common items, such as razor blades, can also include handles with arching or curvature. Examples include the Bic® Soleil® sensitive advanced™ women's disposable 5-blade razor and the Gillette® Mach3 men's disposable razor.

While handles for attachment to brush heads have been made and used, it is believed that no one prior to the inventors has made or used the invention described in the appended claims.

SUMMARY

A handle, for attachment to a brush head having a plate with a back side and a front side, includes a top surface and a bottom surface. The handle also includes a first section spanning from a proximal plane to a first distal plane, with respect to the brush head. The first section, along the top surface, forms an obtuse angle with respect to the back side of the plate when the handle is attached to the brush head, for allowing a finger of a hand of a person to rest against the back side of the plate. The handle also includes a second section spanning from the first distal plane to a terminal point, with respect to the brush head. The handle also includes a first arch spanning along the top surface from the proximal plane to the terminal point, also for allowing the finger to rest. The handle further includes a second arch spanning along the bottom surface from the first distal plane to the terminal point. The first section has a frustoconical profile spanning from the proximal plane to the first distal plane, also for allowing the finger to rest. The frustoconical profile increases in width in a 360° direction along an oblique axis between the proximal plane and the first distal plane. The terminal point is aligned with the plate of the brush head when the handle is attached to the brush head.

A handle, for attachment to a brush head having a plate with a back side and a front side, includes a top surface and a bottom surface. The handle also includes a first section spanning from a proximal plane to a first distal plane, with respect to the brush head. The first section, along the top surface, forms an obtuse angle, ranging from 120° to 170°, with respect to the back side of the plate when the handle is attached to the brush head, for allowing a finger of a hand of a person to rest against the back side of the plate. The handle also includes a second section spanning from the first distal plane to a terminal point, with respect to the brush head. The handle also includes a first arch spanning along the top surface from the proximal plane to the terminal point, also for allowing the finger to rest. The handle also includes a second arch spanning along the bottom surface from the first distal plane to the terminal point. The first section has a frustoconical profile spanning from the proximal plane to the first distal plane, also for allowing the finger to rest. The frustoconical profile increases in width in a 360° direction along an oblique axis between the proximal plane and the first distal plane. The first arch has a maximum point and is convex with respect to the bottom surface. The second arch also has a maximum point and is concave with respect to the top surface. The maximum point of the first arch is aligned with the maximum point of the second arch along an axis. The first arch and the second arch meet at the terminal point for allowing the second section to be held against a palm of the hand of the person. The terminal point is aligned with the plate of the brush head when the handle is attached to the brush head.

A handle, for attachment to a brush head having a back side and a front side, includes a top surface and a bottom surface. The handle also includes a first section spanning from a proximal plane to a first distal plane, with respect to the brush head. The proximal plane is not parallel to the first distal plane along both the top surface and the bottom surface. The first section, along the top surface, forms an obtuse angle, ranging from 120° to 170°, with respect to the back side of the plate when the handle is attached to the brush head, for allowing a finger of a hand of a person to rest against the back side of the plate. The handle also includes a second section spanning from the first distal plane to a terminal point, with respect to the brush head. The handle also includes a first arch spanning along the top surface from the proximal plane to the terminal point, also for allowing the finger to rest. The handle also includes a second arch spanning along the bottom surface from the first distal plane to the terminal point. The first section has a frustoconical profile spanning from the proximal plane to the first distal plane, also for allowing the finger to rest. The frustoconical profile increases in width in a 360° direction along an oblique axis between the proximal plane and the first distal plane. The second section decreases concavely in width from the first distal plane to a second distal plane, with respect to the brush head, to form a constriction allowing for a plurality of fingers of the hand of the person to wrap around the handle and to pinch the frustoconical profile at the first distal plane. The terminal point is aligned with the plate of the brush head when the handle is attached to the brush head.

BRIEF DESCRIPTION OF THE FIGURES

The accompanying drawings, which are incorporated in and constitute a part of this specification, illustrate embodiments of the invention, and, together with the general description of the invention given above, and the detailed description of the embodiments given below, serve to explain the principles of the present invention.

DETAILED DESCRIPTION

The following description of certain examples of the invention should not be used to limit the scope of the present invention. Other examples, features, aspects, embodiments, and advantages of the invention will become apparent to those skilled in the art from the following description, which is by way of illustration, one of the best modes contemplated for carrying out the invention. As will be realized, the invention is capable of other different and obvious aspects, all without departing from the invention. Accordingly, the drawings and descriptions should be regarded as illustrative in nature and not restrictive.

To the extent that spatial terms such as "top," "bottom," "upper," "lower," "vertical," "horizontal," or the like are used herein with reference to the drawings, it will be appreciated that such terms are used for exemplary description purposes only and are not intended to be limiting or absolute.

The handle of the present application allows for an ergonomic positioning of a finger while the brush head and the handle are in use. A user can control force of brushing, so as to not feel pain when while applying the brush head to one's face. An obtuse angle formed between a back side of the brush head and the first section of the handle prevents fingers of a person holding the handle from touching a facial skin surface. A first arch, in tandem with the frustoconical profile of the first section, allows a person to put one finger (e.g., an index finger) on the back side of the brush head, while allowing the finger to rest upon the first section of the handle. A second section, in tandem with both the first arch and a second arch, allows for the person to hold the handle comfortably against a palm of a hand. That is, the handle can be held in such a manner that reduces pain and does not require awkward bending or twisting of the hand during use. As such, a person can maintain a suitable downward pressure of the brush head on the facial skin surface (i.e., not too little to be non-efficacious, yet not too much to cause discomfort or damage to the facial skin surface).

Figure 1:
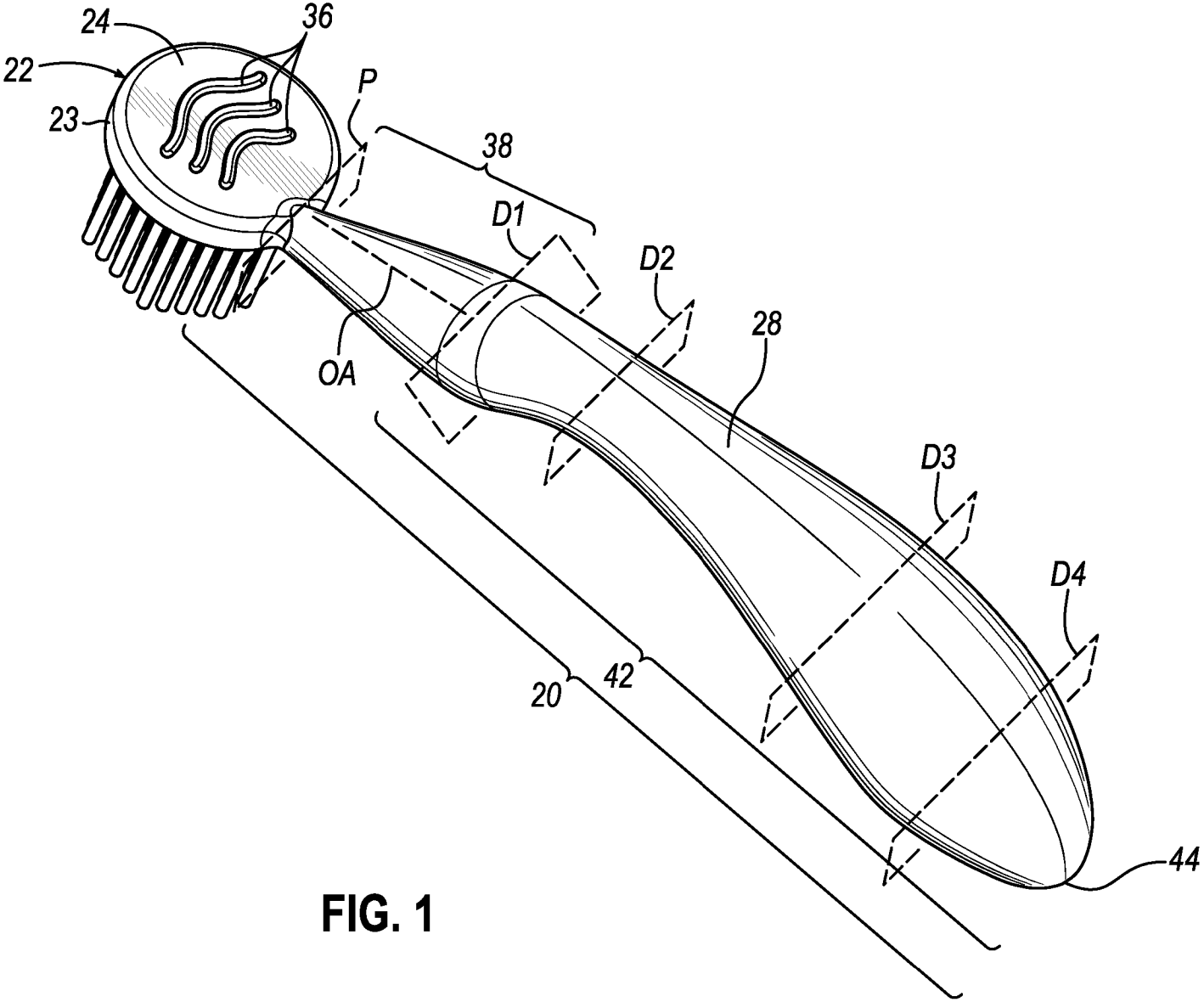
FIG. 1 illustrates a top perspective view of a handle for attachment to a brush head, according to an exemplary embodiment.
Figure 2A:
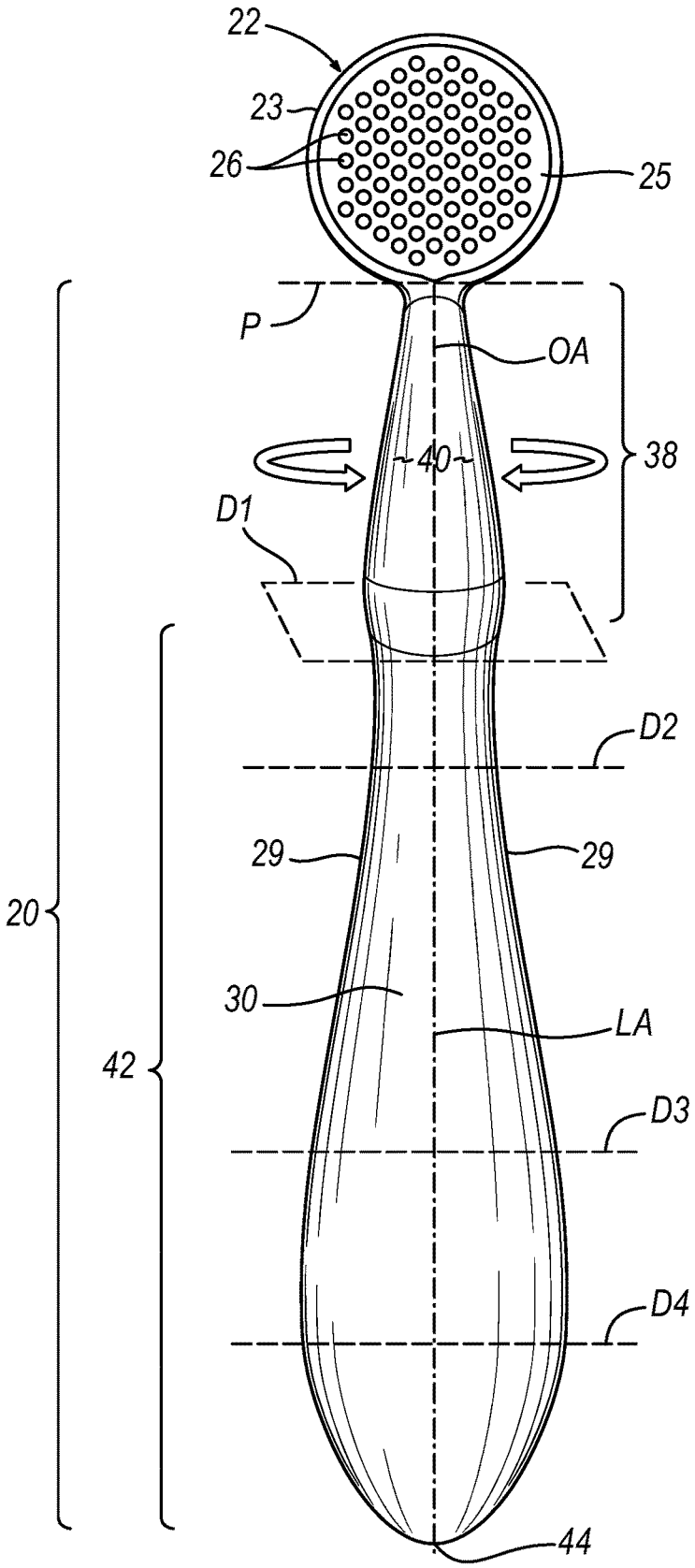
FIG. 2A illustrates a bottom plan view of the handle of FIG. 1.
Figure 2B:
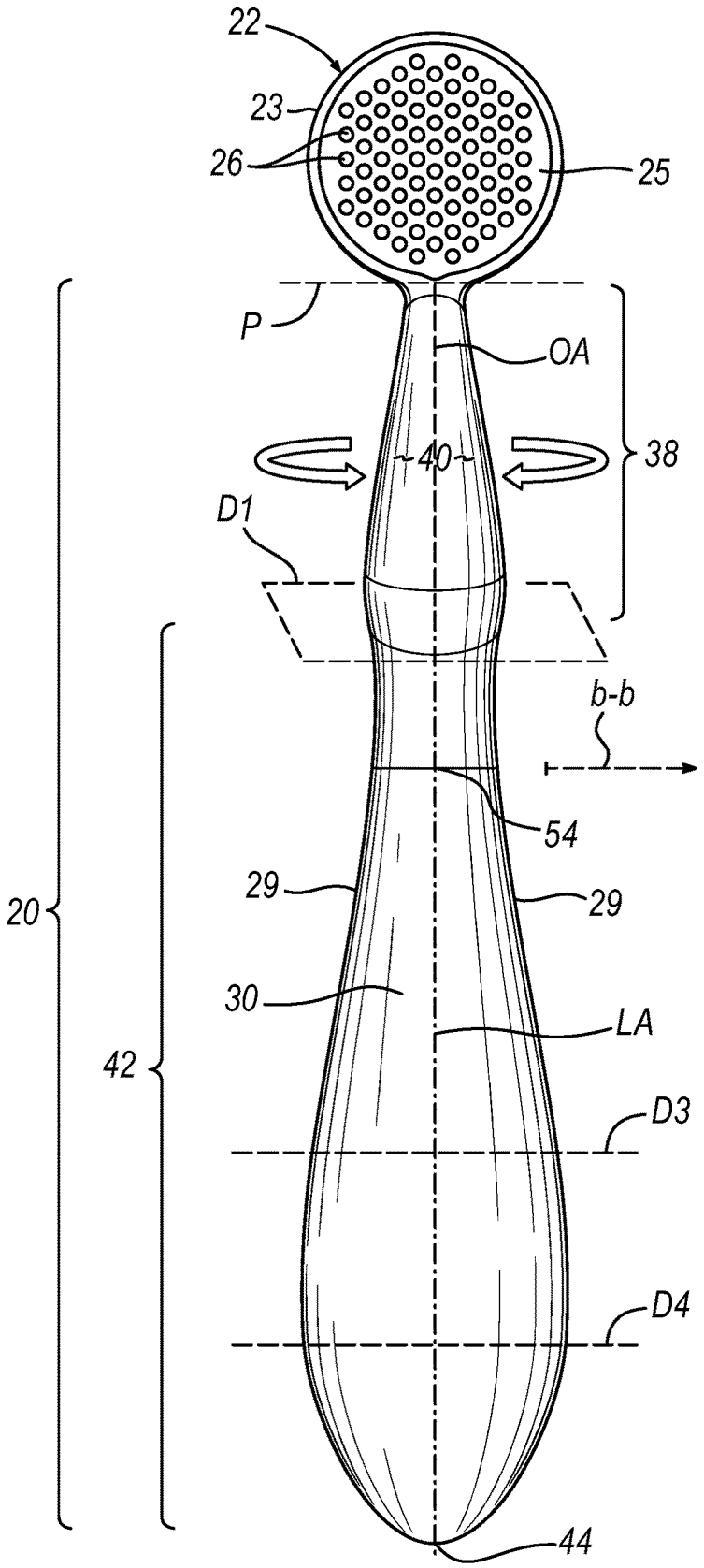
FIG. 2B illustrates a bottom plan view of the handle of FIG. 1.
Figure 2C:
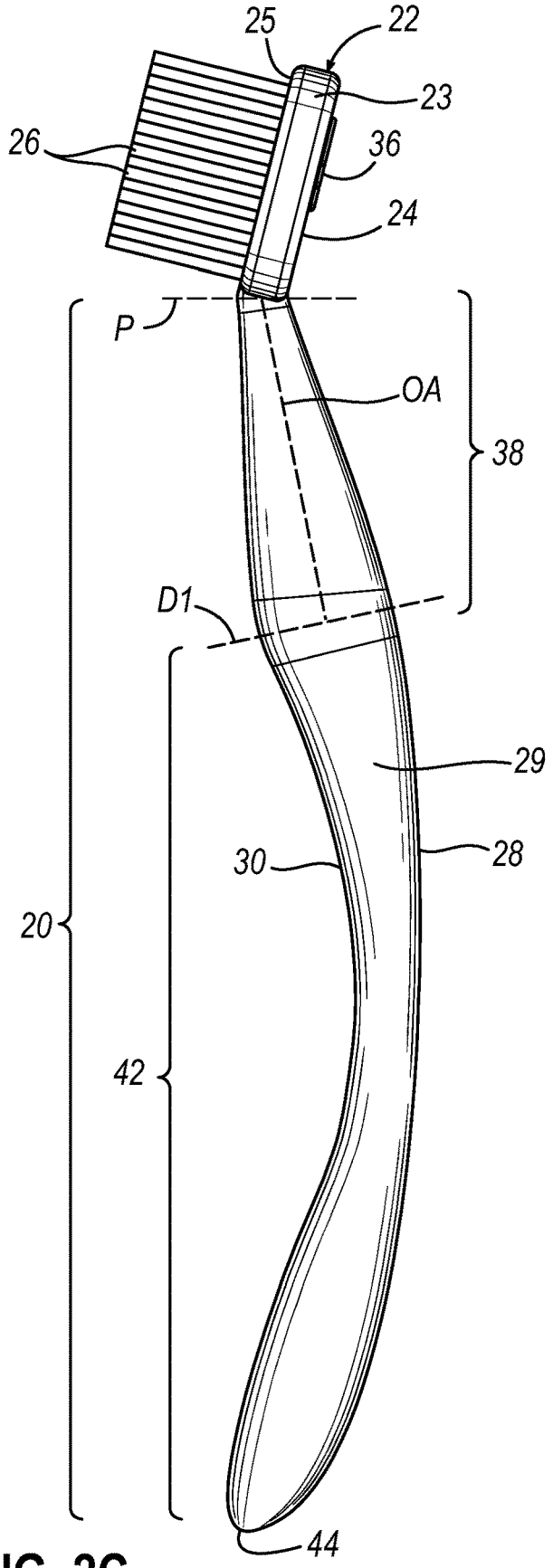
FIG. 2C illustrates a vertical left side view of the handle of FIG. 1.
Figure 2D:
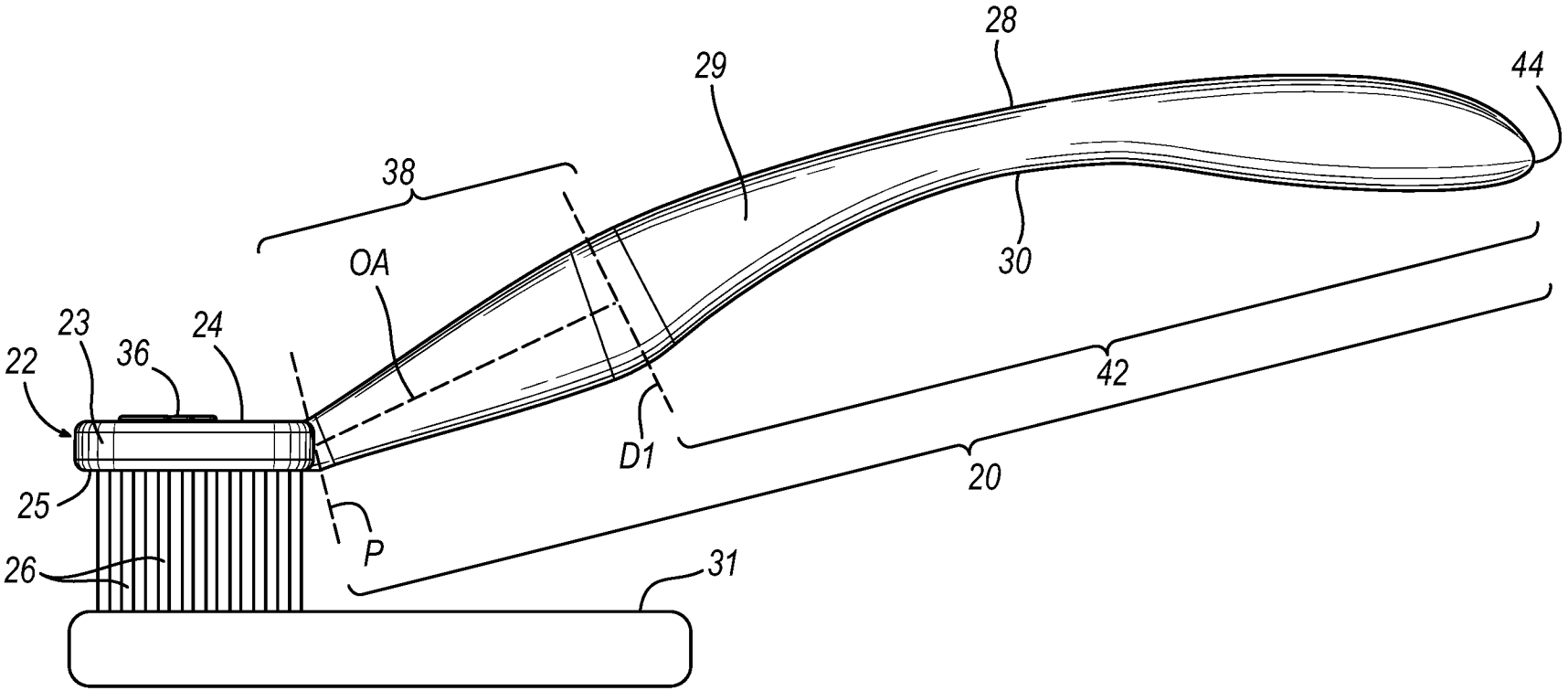
FIG. 2D illustrates the handle of FIG. 1, showing the brush head applied to a facial skin surface.
Figure 3A:
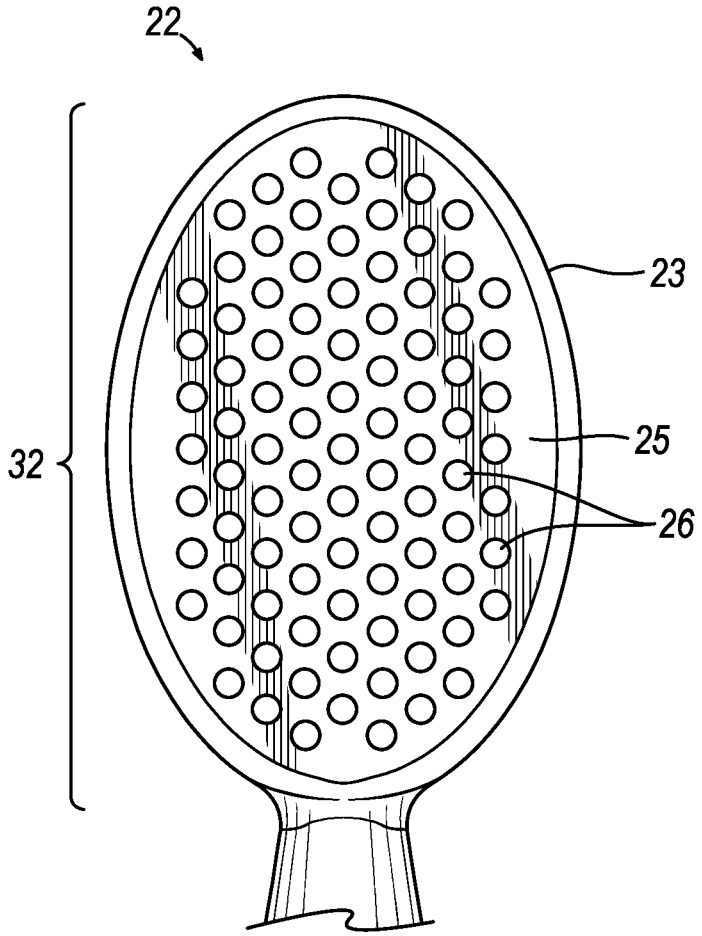
FIG. 3A illustrates a plan view of a front side of an example of a plate of a brush head for use with the handle of FIG. 1, according to an exemplary embodiment.
Figure 3B:
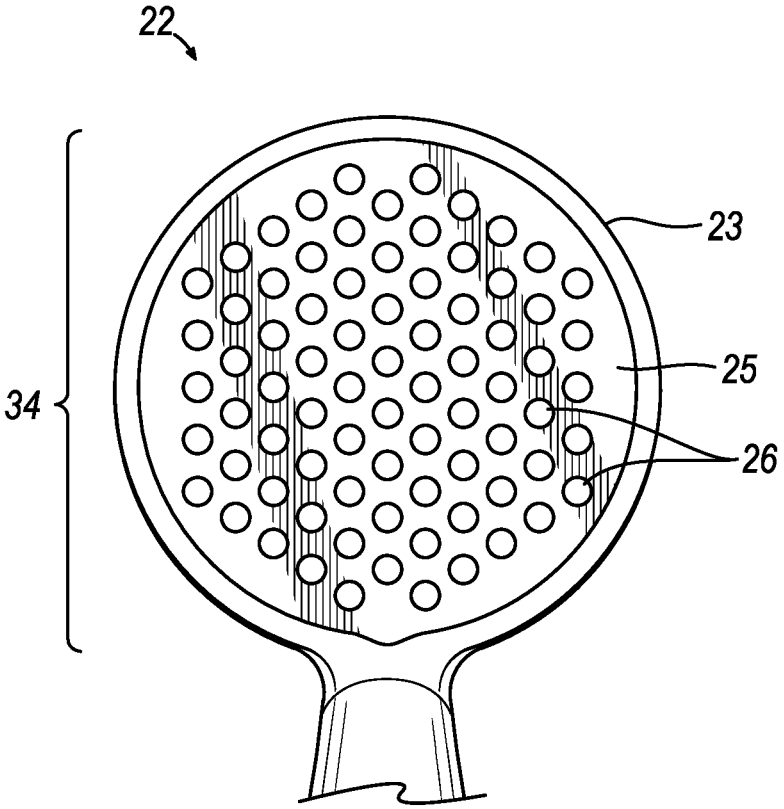
FIG. 3B illustrates a plan view of a front side of an example of a plate of a brush head for use with the handle of FIG. 1, according to an exemplary embodiment.
Figure 3C:
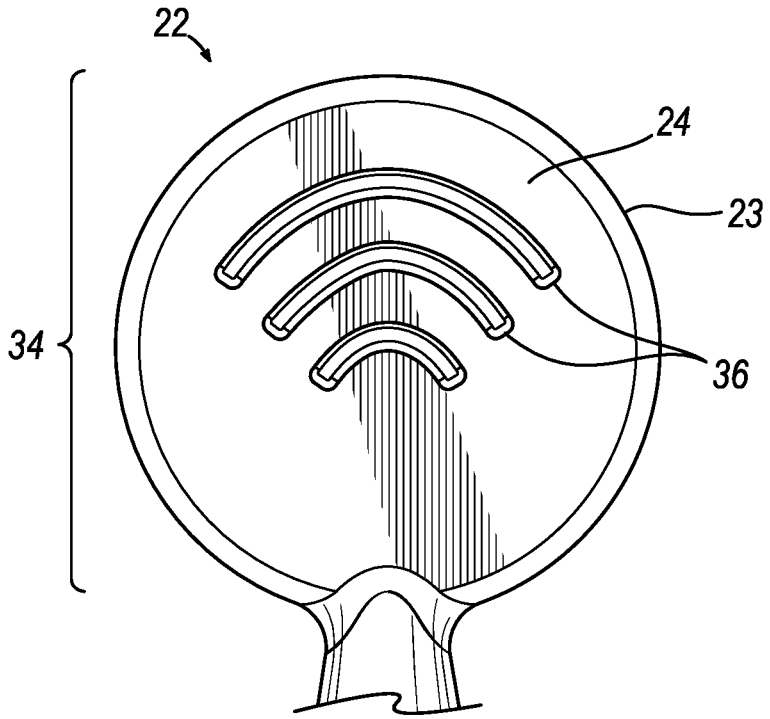
FIG. 3C illustrates a plan view of a back side of an example of a plate of a brush head for use with the handle of FIG. 1, according to an exemplary embodiment.

As first illustrated in FIG. 1, a handle 20, for attachment to a brush head 22 is presented. The brush head 22 includes a plate 23 having a back side 24 (FIG. 1) and a front side 25 (FIGS. 2A-2B). The brush head 22 also includes a plurality of bristles 26 (FIG. 2C) extending out from the front side 25 of the plate 23. The handle 20 includes a top surface 28 (FIGS. 1 and 2C) and a bottom surface 30 (FIGS. 2A-2C). The handle 20 also has two opposing side surfaces 29. While FIG. 2C depicts a left side surface 29 (with respect to the top surface 28), it is understood that a right side surface would be identical. The brush head 22 is, for instance, used to clean a facial skin surface 31 (FIG. 2D). The plate 23 may have a shape of an ellipse 32 (FIG. 3A) or of a circle 34 (FIG. 3B). In one instance, the back side 24 of the plate 23 includes a plurality of protrusions 36 (FIG. 3C) for providing a grip to a finger (e.g., an index finger) of a hand of a person (i.e., a user). As illustrated in FIG. 3C, the protrusions 36 may be, for instance, shaped as arches. Alternatively, the back side 24 of the plate 23 may have a textured surface, such as raised dots.

Example of a First Section of a Handle

Figure 4:
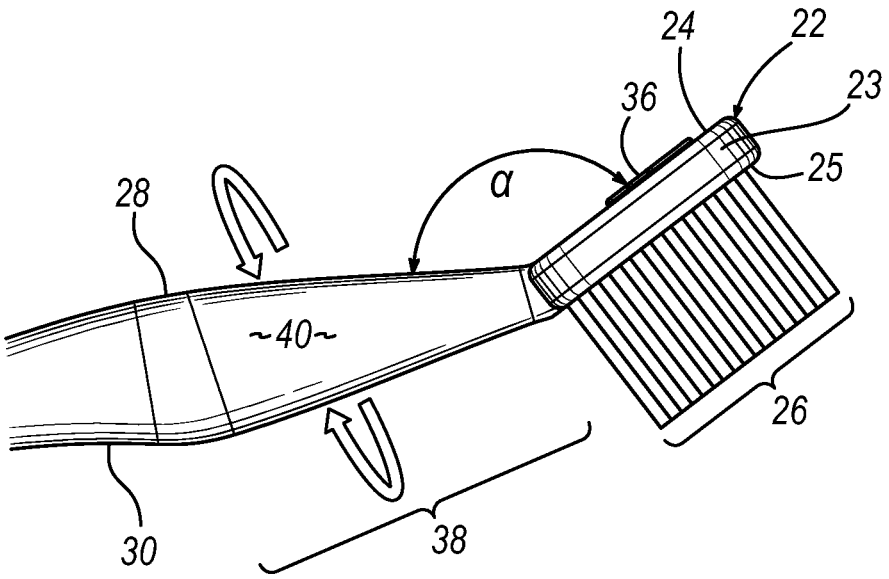
FIG. 4 illustrates a partial right side view of the handle of FIG. 1.

As illustrated in FIG. 1, the handle 20 includes a first section 38 spanning from a proximal plane P to a first distal plane D1, with respect to the brush head 22. The first distal plane D1 is oblique (i.e., non-parallel) to the proximal plane P. When the handle 20 is attached to the brush head 22 as shown in the FIGS., the first section 38, along the top surface 28 of the handle 20, forms an obtuse angle $\alpha$ with respect to the back side 24 of the plate 23 of the brush head 22, indicated in FIG. 4. In one instance, the obtuse angle $\alpha$ ranges from 120° to 170°. In another instance, the obtuse angle $\alpha$ ranges from 130° to 160°. In a further instance, the obtuse angle $\alpha$ ranges from 135° to 155°. In yet a further instance, the obtuse angle $\alpha$ ranges from 140° to 150°. In a particular instance, the obtuse angle $\alpha$ is 146°. The obtuse angle $\alpha$ may be such that the first section 38 is angled away from the plurality of bristles 26. As later depicted in FIGS. 6A-6B, the obtuse angle $\alpha$ prevents a finger, for instance an index finger I, of the hand of the person holding the handle 20 from touching the facial skin surface 31 and allows for an ergonomic positioning of the finger (e.g., the index finger I) while the brush head 22 and the handle 20 are in use. The obtuse angle $\alpha$ (and by extension, the first section 38) separates a plurality of fingers (for instance, a middle finger M, a ring finger R, a pinky Q, and a thumb Z in FIGS. 6A-6B) from the brush head 22. The obtuse angle $\alpha$ also allows the finger (e.g., the index finger I) to rest against the back side 24 of the plate 23 of the brush head 22.

Figure 5A:
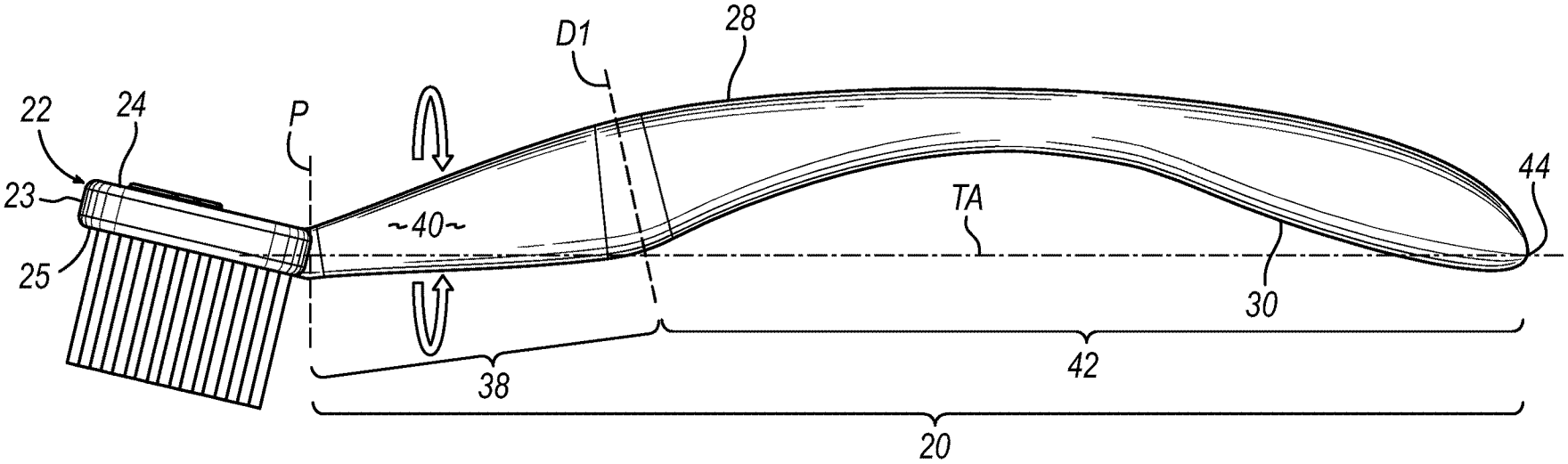
FIG. 5A illustrates a horizontal left side view of the handle of FIG. 1.
Figure 5B:
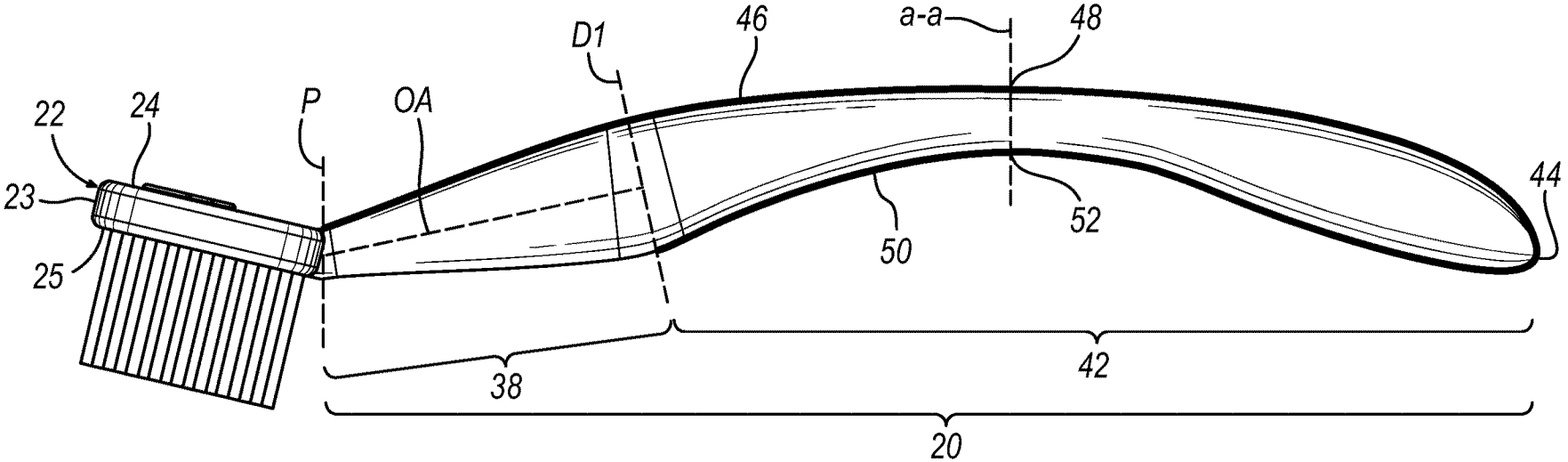
FIG. 5B illustrates a horizontal left side view of the handle of FIG. 1.

As first indicated in FIG. 2A-2D, and again in FIGS. 5A-5B, the first section 38 has a frustoconical profile 40 spanning from the proximal plane P to the first distal plane D1. The frustoconical profile 40 increases in width in a 360° direction along an oblique axis OA between the proximal plane P and the first distal plane D1. Specifically, along the oblique axis OA, the frustoconical profile 40 may increase in width from the proximal plane P to the first distal plane D1. As best depicted in FIG. 5B, the oblique axis OA is perpendicular to the first distal plane D1 and oblique (i.e., non-perpendicular) to the proximal plane P. In one instance, the frustoconical profile 40 measures from 8 mm to 14 mm in width at the first distal plane D1. In another instance, the frustoconical profile 40 measures from 10 mm to 12 mm in width at the first distal plane D1. In a further instance, the frustoconical profile 40 measures 11 mm in width at the first distal plane D1. The finger (e.g., the index finger I) is allowed to also rest against the frustoconical profile 40. Like the obtuse angle α, the frustoconical profile 40 also separates fingers M, R, Q, Z from the brush head 22.

Examples of a Second Section, a First Arch, and a Second Arch of a Handle

As first illustrated in FIGS. 1-2B and again in FIGS. 5A-5B, the handle 20 also includes a second section 42 spanning from the first distal plane D1 to a terminal point 44, with respect to the brush head 22. When the handle 20 is attached to the brush head 22, the terminal point 44 is aligned with the plate 23. This can be seen when the handle 20 is in a horizontal side view, as in FIG. 5A. A transverse axis TA passes from the terminal point 44 through the proximal plane P to the plate 23. In one instance (not shown), the terminal point 44 may be aligned with the front side 25 of the plate 23. In another instance (not shown), the terminal point 44 may be aligned with the back side 24 of the plate 23. The second section 42 will be described further below.

Figure 6A:
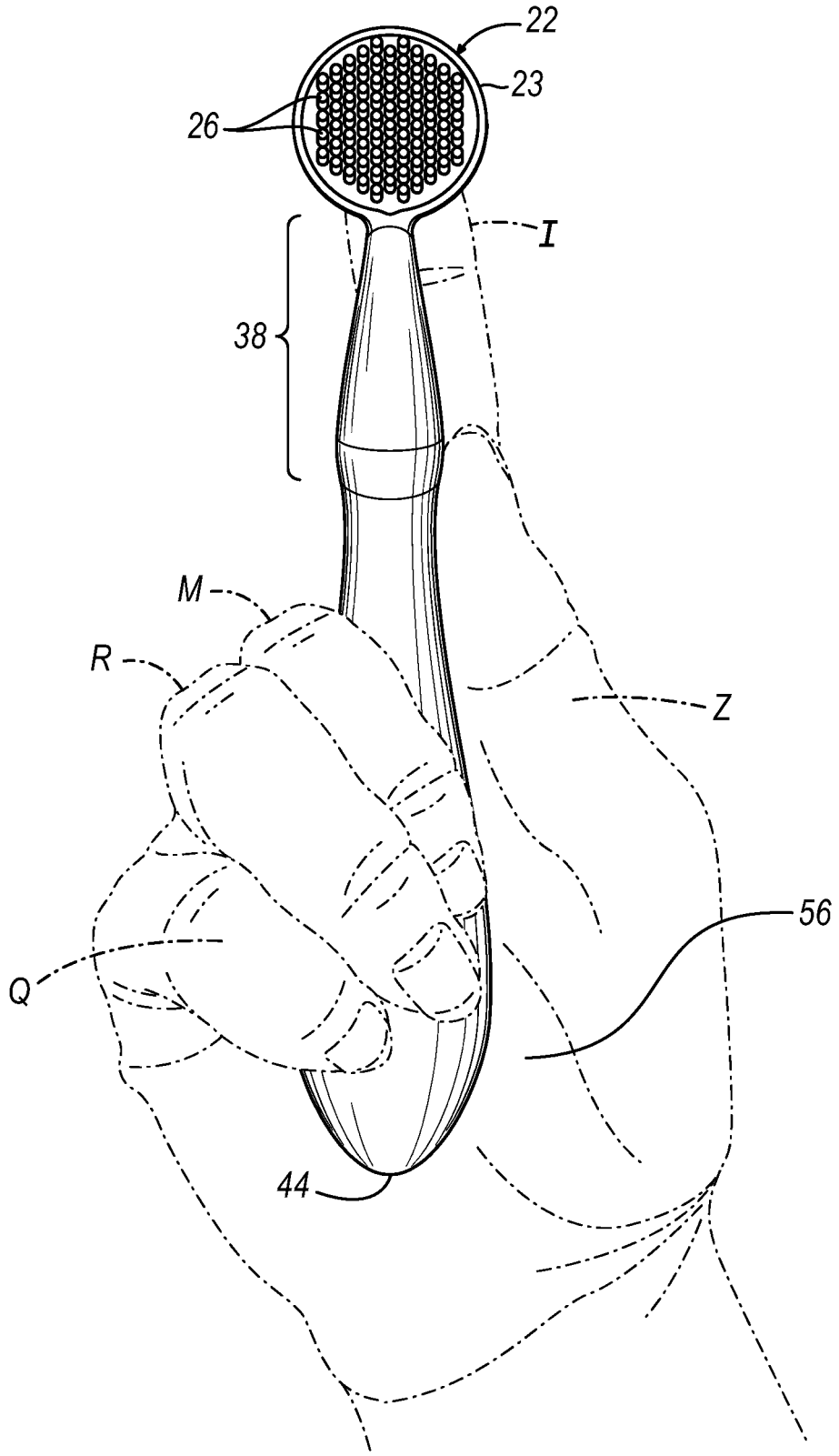
FIG. 6A illustrates a bottom plan view of the handle of FIG. 1 held by a user, according to an exemplary embodiment.
Figure 6B:
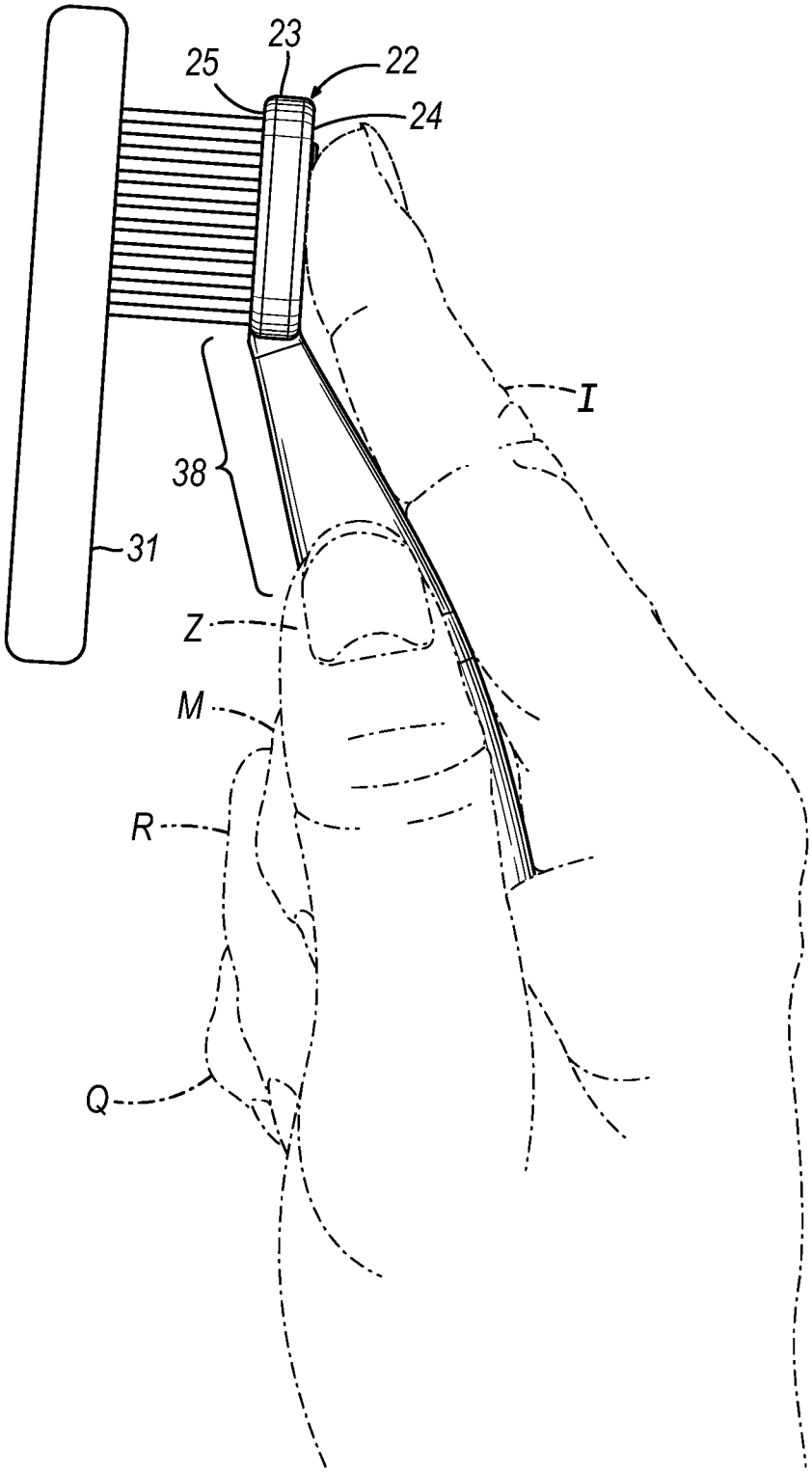
FIG. 6B illustrates a vertical left side view of the handle of FIG. 1 held by a user, according to an exemplary embodiment.

As indicated by a heavy line in FIG. 5B, the handle 20 further includes a first arch 46 spanning along the top surface 28 from the proximal plane P to the terminal point 44. That is, the first arch 46 spans through both the first section 38 and the second section 42. The first arch 46 has a maximum point 48 and is convex with respect to the bottom surface 30. That is, when viewed from the bottom surface 30, the first arch 46 is convex, with the maximum point 48 facing away from the bottom surface 30. The first arch 46 ascends from the proximal plane P to the maximum point 48 and descends from the maximum point 48 to the terminal point 44. The first arch 46, in tandem with the frustoconical profile 40 of the first section 38, allows a person to put a finger, for instance the index finger I, on the back side 24 of the brush head 22, while allowing the finger (e.g., the index finger I) to rest upon the first section 38 of the handle 20 along the top surface 28. The first arch 46 may be symmetric or, as depicted in FIG. 6B, asymmetric.

As indicated by a heavy line in FIG. 5B, the handle 20 also has a second arch 50 spanning along the bottom surface 30 from the first distal plane D1 to the terminal point 44. That is, the second arch 50 spans through the second section 42 only. Similar to the first arch 46, the second arch 50 also has a maximum point 52 and is concave with respect to the top surface 28. That is, when viewed from the top surface 28, the second arch 50 is concave, with the maximum point 52 facing towards the top surface 28. The second arch 50 ascends from the first distal plane D1 to the maximum point 52 and descends from the maximum point 52 to the terminal point 44. The maximum point 52 of the second arch 50 is aligned with the maximum point 48 of the first arch 46 along an axis a-a, when the handle 20 is viewed horizontally sidewise (FIG. 5B). The second arch 50 may be symmetric or, as depicted in FIG. 5B, asymmetric. As illustrated in FIG. 5B, the first arch 46 and the second arch 50 meet at the terminal point 44.

The second section 42 of the handle 20 decreases concavely in width from the first distal plane D1 to a second distal plane D2, with respect to the brush head 22 (see FIG. 2A). That is, the second section 42 decreases in width along both the top surface 28 and the bottom surface 30 from the first distal plane D1 to the second distal plane D2 while maintaining a concave profile with respect to a longitudinal axis LA (see FIG. 2A). The second distal plane D2 is parallel to the proximal plane P. This forms a constriction 54 (see FIG. 2B), that is, a portion of the second section 42 having a concave profile and a narrowest width, along an axis b-b, of the second section 42 when the handle 20 is viewed from either top or bottom. The constriction 54 is contained within the second distal plane D2. The constriction 54, being narrower in width than the frustoconical profile 40 measured at the first distal plane D1, allows for a plurality of fingers (for instance, a middle finger M, a ring finger R, a pinky Q, and a thumb Z) of a hand of a person to wrap around the handle 20 and to pinch (e.g., using a combination of the index finger I, the middle finger M and the thumb T) the frustoconical profile 40 at the first distal plane D1.

Also detailed in FIGS. 2A-2B, the second section 42 then increases concavely in width from the second distal plane D2 to a third distal plane D3. That is, the second section 42 increases in width along both the top surface 28 and the bottom surface 30 from the second distal plane D2 to the third distal plane D3 while maintaining a concave profile with respect to the longitudinal axis LA. The third distal plane D3 is parallel to the second distal plane D2, and thus also parallel to the proximal plane P.

Further detailed in FIGS. 2A-2B, the second section 42 then increases convexly in width from the third distal plane D3 to a fourth distal plane D4. That is, the second section 42 increases in width along both the top surface 28 and the bottom surface 30 from the third distal plane D3 to the fourth distal plane D4 while maintaining a convex profile with respect to the longitudinal axis LA. The fourth distal plane D4 is parallel to the second distal plane D2, and thus also parallel to the proximal plane P.

Again in FIGS. 2A-2B, the second section 42 then decreases convexly in width from the fourth distal plane D4 to the terminal point 44. That is, the second section 42 increases in width along both the top surface 28 and the bottom surface 30 from the third distal plane D3 to the fourth distal plane D4, before narrowing again from the fourth distal plane D4 to the terminal point 44. A convex profile, with respect to the longitudinal axis LA, is maintained between the fourth distal plane D4 and the terminal point 44, as observed when the handle 20 is viewed from either top or bottom (for instance, in FIG. 2A). As previously described, the first arch 46 and the second arch 50 meet at the terminal point 44, allowing for the person to hold the second section 42 comfortably against a palm 56 of a hand (FIG. 6A). In particular, the second section 42 between the fourth distal plane D4 and the terminal point 44 may be allowed to rest against the palm 56, as illustrated in FIG. 6A. That is, the handle 20 can be held in such a manner that does not require awkward bending or twisting of the hand during use.

The handle 20 can be made using known methods such as 3D-printing and 1-piece silicone molding. The handle 20 can be made integrally with the plate 23, i.e., the handle 20 and the plate 23 of the brush head 22 are formed together as a unitary piece. Alternatively, the handle 20 can be made separately from, and later joined to, the plate 23. The joining can be done as a separate step in manufacturing or just before use of the handle 20 with the brush head 22. The handle 20 can then remain attached to the brush head 22 or can be removed from the brush head 22 between uses (for example, to change out the brush head 22 once the bristles 26 have become worn down).

In either of the above manufacturing methods, the handle 20 and the brush head 22 are to be put together to form a brush assembly. That is, the brush assembly includes the handle 20 and the brush 22 with all features as described herein.

Any numerical values provided herein, including ranges and point values, have a tolerance of ±1%.

Exemplary Combinations

The following examples relate to various non-exhaustive ways in which the teachings herein may be combined or applied. It should be understood that the following examples are not intended to restrict the coverage of any claims that may be presented at any time in this application or in subsequent filings of this application. No disclaimer is intended. The following examples are being provided for nothing more than merely illustrative purposes. It is contemplated that the various teachings herein may be arranged and applied in numerous other ways. It is also contemplated that some variations may omit certain features referred to in the below examples. Therefore, none of the aspects or features referred to below should be deemed critical unless otherwise explicitly indicated as such at a later date by the inventors or by a successor in interest to the inventors. If any claims are presented in this application or in subsequent filings related to this application that include additional features beyond those referred to below, those additional features shall not be presumed to have been added for any reason relating to patentability.

EXAMPLE 1

A handle, for attachment to a brush head having a plate with a back side and a front side, the handle comprising: a top surface and a bottom surface; a first section spanning from a proximal plane to a first distal plane, with respect to the brush head; the first section, along the top surface, forming an obtuse angle with respect to the back side of the plate when the handle is attached to the brush head, for allowing a finger of a hand of a person to rest against the back side of the plate; a second section spanning from the first distal plane to a terminal point, with respect to the brush head; a first arch spanning along the top surface from the proximal plane to the terminal point, also for allowing the finger to rest; a second arch spanning along the bottom surface from the first distal plane to the terminal point; wherein the first section has a frustoconical profile spanning from the proximal plane to the first distal plane, also for allowing the finger to rest; wherein the frustoconical profile increases in width in a 360° direction along an oblique axis between the proximal plane and the first distal plane; wherein the terminal point is aligned with the plate of the brush head when the handle is attached to the brush head.

EXAMPLE 2

The handle of Example 1, wherein: the first arch has a maximum point and is convex with respect to the bottom surface; the first arch ascends from the proximal plane to the maximum point and descends from the maximum point to the terminal point; the second arch also has a maximum point and is concave with respect to the top surface; the second arch ascends from the first distal plane to the maximum point and descends from the maximum point to the terminal point; and the maximum point of the first arch is aligned with the maximum point of the second arch along an axis.

EXAMPLE 3

The handle of any of Examples 1 through 2, wherein the first arch and the second arch meet at the terminal point for allowing the second section to be held against a palm of the hand of the person.

EXAMPLE 4

The handle of any of Examples 1 through 3, wherein the second section decreases concavely in width from the first distal plane to a second distal plane, with respect to the brush head, to form a constriction allowing for a plurality of fingers of the hand of the person to wrap around the handle and to pinch the frustoconical profile at the first distal plane.

EXAMPLE 5

The handle of Example 4, wherein the second section increases concavely in width from the second distal plane to a third distal plane, with respect to the brush head.

EXAMPLE 6

The handle of Example 5, wherein the second section increases convexly in width from the third distal plane to a fourth distal plane, with respect to the brush head.

EXAMPLE 7

The handle of Example 6, wherein the second section decreases convexly in width from the fourth distal plane to the terminal point.

EXAMPLE 8

The handle of any of Examples 1 through 7, wherein the obtuse angle ranges from 120° to 170°.

EXAMPLE 9

A handle, for attachment to a brush head having a plate with a back side and a front side, the handle comprising: a top surface and a bottom surface; a first section spanning from a proximal plane to a first distal plane, with respect to the brush head; the first section, along the top surface, forming an obtuse angle, ranging from 120° to 170°, with respect to the back side of the plate when the handle is attached to the brush head, for allowing a finger of a hand of a person to rest against the back side of the plate; a second section spanning from the first distal plane to a terminal point, with respect to the brush head; a first arch spanning along the top surface from the proximal plane to the terminal point, also for allowing the finger to rest; a second arch spanning along the bottom surface from the first distal plane to the terminal point; wherein the first section has a frustoconical profile spanning from the proximal plane to the first distal plane, also for allowing the finger to rest; wherein the frustoconical profile increases in width in a 360° direction along an oblique axis between the proximal plane and the first distal plane; wherein the first arch has a maximum point and is convex with respect to the bottom surface; wherein the second arch also has a maximum point and is concave with respect to the top surface; wherein the maximum point of the first arch is aligned with the maximum point of the second arch along an axis; wherein the first arch and the second arch meet at the terminal point for allowing the second section to be held against a palm of the hand of the person; wherein the terminal point is aligned with the plate of the brush head when the handle is attached to the brush head.

EXAMPLE 10

The handle of Example 9, wherein: the first arch ascends from the proximal plane to the respective maximum point and descends from the respective maximum point to the terminal point; and the second arch ascends from the first distal plane to the respective maximum point and descends from the respective maximum point to the terminal point.

EXAMPLE 11

The handle of any of Examples 9 through 10, wherein the second section decreases concavely in width from the first distal plane to a second distal plane, with respect to the brush head, to form a constriction allowing for a plurality of fingers of the hand of the person to wrap around the handle and to pinch the frustoconical profile at the first distal plane.

EXAMPLE 12

The handle of Example 11, wherein: the second section increases concavely in width from the second distal plane to a third distal plane, with respect to the brush head; and the section increases convexly in width from the third distal plane to a fourth distal plane, with respect to the brush head.

EXAMPLE 13

The handle of Example 12, wherein the second section decreases convexly in width from the fourth distal plane to the terminal point.

EXAMPLE 14

A handle, for attachment to a brush head having a back side and a front side, the handle comprising: a top surface and a bottom surface; a first section spanning from a proximal plane to a first distal plane, with respect to the brush head; wherein the proximal plane is not parallel to the first distal plane along both the top surface and the bottom surface; the first section, along the top surface, forming an obtuse angle, ranging from 120° to 170°, with respect to the back side of the plate when the handle is attached to the brush head, for allowing a finger of a hand of a person to rest against the back side of the plate; a second section spanning from the first distal plane to a terminal point, with respect to the brush head; a first arch spanning along the top surface from the proximal plane to the terminal point, also for allowing the finger to rest; a second arch spanning along the bottom surface from the first distal plane to the terminal point; wherein the first section has a frustoconical profile spanning from the proximal plane to the first distal plane, also for allowing the finger to rest; wherein the frustoconical profile increases in width in a 360° direction along an oblique axis between the proximal plane and the first distal plane; wherein the second section decreases concavely in width from the first distal plane to a second distal plane, with respect to the brush head, to form a constriction allowing for a plurality of fingers of the hand of the person to wrap around the handle and to pinch the frustoconical profile at the first distal plane; and wherein the terminal point is aligned with the plate of the brush head when the handle is attached to the brush head.

EXAMPLE 15

The handle of Example 14, wherein: the first arch has a maximum point and is convex with respect to the bottom surface; and the first arch ascends from the proximal plane to the maximum point and descends from the maximum point to the terminal point.

EXAMPLE 16

The handle of Example 15, wherein: the second arch also has a maximum point and is concave with respect to the top surface; and the second arch ascends from the first distal plane to the maximum point and descends from the maximum point to the terminal point.

EXAMPLE 17

The handle of Example 16, wherein: the maximum point of the first arch is aligned with the maximum point of the second arch along an axis; and the first arch and the second arch meet at the terminal point for allowing the second section to be held against a palm of the hand of the person.

EXAMPLE 18

The handle of any of Examples 14 through 17, wherein the second section increases concavely in width from the second distal plane to a third distal plane, with respect to the brush head.

EXAMPLE 19

The handle of Example 18, wherein the second section increases convexly in width from the third distal plane to a fourth distal plane, with respect to the brush head.

EXAMPLE 20

The handle of Example 19, wherein the second section decreases convexly in width from the fourth distal plane to the terminal point.

Miscellaneous

It should be understood that any one or more of the teachings, expressions, embodiments, examples, etc. described herein may be combined with any one or more of the other teachings, expressions, embodiments, examples, etc. that are described herein. The above-described teachings, expressions, embodiments, examples, etc. should therefore not be viewed in isolation relative to each other. Various suitable ways in which the teachings herein may be combined will be readily apparent to those of ordinary skill in the art in view of the teachings herein. Such modifications and variations are intended to be included within the scope of the claims.

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometrics, materials, dimensions, ratios, steps, and the like discussed above are illustrative and are not required. Accordingly, the scope of the present invention should be considered in terms of the following claims and is understood not to be limited to the details of structure and operation shown and described in the specification and drawings.

What is claimed is:

1. A handle, for attachment to a brush head having a plate with a back side and a front side, the handle consisting of:
a top surface and a bottom surface;
a first section spanning from a proximal plane to a first distal plane, with respect to the brush head;
wherein the proximal plane is not parallel to the first distal plane along both the top surface and the bottom surface;
the first section, along the top surface, forming an obtuse angle with respect to the back side of the plate when the handle is attached to the brush head, for allowing a finger of a hand of a person to rest against the back side of the plate;
a second section spanning from the first distal plane to a terminal point, with respect to the brush head;
a first arch spanning along the top surface from the proximal plane to the terminal point, also for allowing the finger to rest;
a second arch spanning along the bottom surface from the first distal plane continuously to the terminal point;
wherein the first section has a frustoconical profile spanning from the proximal plane to the first distal plane, also for allowing the finger to rest;
wherein the frustoconical profile increases continuously in width in a 360° direction along an oblique axis between the proximal plane and the first distal plane;
wherein the first arch has a maximum point and is convex with respect to the bottom surface;
wherein the first arch ascends from the proximal plane to the maximum point and descends from the maximum point to the terminal point;
wherein the second arch also has a maximum point and is concave with respect to the top surface;
wherein the second arch ascends from the first distal plane to the maximum point and descends from the maximum point to the terminal point;
wherein the maximum point of the first arch is aligned with the maximum point of the second arch along an axis;
wherein the first arch and the second arch meet at the terminal point for allowing the second section to be held against a palm of the hand of the person;
wherein the second section decreases concavely in width from the first distal plane to a second distal plane, with respect to the brush head, to form a constriction allowing for a plurality of fingers of the hand of the person to wrap around the handle and to pinch the frustoconical profile at the first distal plane;
wherein the second section increases concavely in width from the second distal plane to a third distal plane, with respect to the brush head;
wherein the second section increases convexly in width from the third distal plane to a fourth distal plane, with respect to the brush head;
wherein the second section decreases convexly in width from the fourth distal plane to the terminal point;
wherein the terminal point is aligned with the plate of the brush head, along a transverse axis that passes from the terminal point to the plate of the brush head, when the handle is attached to the brush head; and
wherein the transverse axis passes through the proximal plane, such that the transverse axis is substantially perpendicular to the proximal plane.

2. The handle of claim 1, wherein the obtuse angle ranges from 120° to 170°.

3. A brush, comprising:
a brush head having a plate with a back side and a front side; and
a handle attached to the brush head, the handle consisting of:
a top surface and a bottom surface;
a first section spanning from a proximal plane to a first distal plane, with respect to the brush head;
wherein the proximal plane is not parallel to the first distal plane along both the top surface and the bottom surface;
the first section, along the top surface, forming an obtuse angle with respect to the back side of the plate when the handle is attached to the brush head, for allowing a finger of a hand of a person to rest against the back side of the plate;
a second section spanning from the first distal plane to a terminal point, with respect to the brush head;
a first arch spanning along the top surface from the proximal plane to the terminal point, also for allowing the finger to rest;
a second arch spanning along the bottom surface from the first distal plane continuously to the terminal point;
wherein the first section has a frustoconical profile spanning from the proximal plane to the first distal plane, also for allowing the finger to rest;
wherein the frustoconical profile increases continuously in width in a 360° direction along an oblique axis between the proximal plane and the first distal plane;
wherein the first arch has a maximum point and is convex with respect to the bottom surface;
wherein the first arch ascends from the proximal plane to the maximum point and descends from the maximum point to the terminal point;
wherein the second arch also has a maximum point and is concave with respect to the top surface;
wherein the second arch ascends from the first distal plane to the maximum point and descends from the maximum point to the terminal point;
wherein the maximum point of the first arch is aligned with the maximum point of the second arch along an axis;
wherein the first arch and the second arch meet at the terminal point for allowing the second section to be held against a palm of the hand of the person;
wherein the second section decreases concavely in width from the first distal plane to a second distal plane, with respect to the brush head, to form a constriction allowing for a plurality of fingers of the hand of the person to wrap around the handle and to pinch the frustoconical profile at the first distal plane;
wherein the second section increases concavely in width from the second distal plane to a third distal plane, with respect to the brush head;
wherein the second section increases convexly in width from the third distal plane to a fourth distal plane, with respect to the brush head;

wherein the second section decreases convexly in width from the fourth distal plane to the terminal point;

wherein the terminal point is aligned with the plate of the brush head, along a transverse axis that passes from the terminal point to the plate of the brush head, when the handle is attached to the brush head; and wherein the transverse axis passes through the proximal plane, such that the transverse axis is substantially perpendicular to the proximal plane.

4. The brush of claim 3, wherein the obtuse angle ranges from 120° to 170°.

* * * * *